US005454152A

United States Patent [19]

Hosseinian

[11] Patent Number: 5,454,152

[45] Date of Patent: Oct. 3, 1995

[54] ROLLER SWAGING TOOL

[75] Inventor: Amir P. Hosseinian, Beverly Hills, Calif.

[73] Assignee: Sierracin Corporation, Sylmar, Calif.

[21] Appl. No.: 120,631

[22] Filed: Sep. 16, 1993

[51] Int. Cl.[6] ..... B23Q 1/00

[52] U.S. Cl. ..... 29/243.518; 29/283.5; 29/237

[58] Field of Search ..... 29/234, 283.5, 29/243.518, 237; 72/122, 123, 126; 285/39

[56] References Cited

U.S. PATENT DOCUMENTS

| | | | |
|---|---|---|---|
| 842,569 | 1/1907 | Mathers . | |
| 2,737,225 | 3/1956 | Jasinski . | |
| 2,772,716 | 12/1956 | Stary . | |
| 2,817,385 | 12/1957 | Benjamin . | |
| 3,641,798 | 2/1972 | Press | 72/122 |
| 3,693,387 | 9/1972 | Blackburn . | |
| 4,102,168 | 7/1978 | Brookes et al. . | |
| 4,134,286 | 1/1979 | Martin . | |
| 4,186,584 | 2/1980 | Schott | 72/122 |
| 4,242,893 | 1/1981 | Diller . | |
| 4,319,472 | 3/1982 | Martin . | |
| 4,615,198 | 10/1986 | Hawkins et al. . | |
| 4,716,752 | 1/1988 | Diller . | |
| 4,793,167 | 12/1988 | Beiley et al. . | |
| 4,940,249 | 7/1990 | Drbal . | |
| 5,040,396 | 8/1991 | Mikhail et al. . | |

FOREIGN PATENT DOCUMENTS

| | | |
|---|---|---|
| 2093968 | 2/1972 | France . |
| 2506326 | 8/1976 | Germany . |

OTHER PUBLICATIONS

Sierracin/Harrison's brochure, "Aerospace Dynamic Beam Seal Fittings", printed Jun., 1987.

*Primary Examiner*—Robert C. Watson

*Attorney, Agent, or Firm*—Denton L. Anderson; Sheldon & Mak, Inc.

[57] ABSTRACT

A swaging unit which is portable and which has a locking fitting to co-operate with separable components to the secure a sleeve in an engagement with the swaging unit. In this manner, a tube can be swaged onto the sleeve. The locking fitting has internal threads which engage with external threads on the separable components to facilitate engagement. The swaging unit can be finely adjusted by having fine threads between a locknut and a cage for housing the mandrel.

18 Claims, 4 Drawing Sheets

ROLLER SWAGING TOOL

BACKGROUND

Providing a roller swaging tool for easy field use, for instance, by aircraft operators that can swage tubes and fittings at locations remote for maintenance sites, is valuable.

This invention relates to a roller swaging tool. In particular invention relates to a tool for use in swaging together a tube with a fitting.

Roller swaging tools using a mandrel which extends axially and forces rollers radially so that the tube is swaged onto a fitting are known. The disadvantages of such known apparatus include the relative bulkiness of the tool, the relative short life of the mandrel and rollers which act under pressure to effect the swaging, and the difficulty of using the tool apart from complex computer controlled machinery.

Portable swaging kits are known; however, the units are relatively bulky, have a relatively short life span, and are quite complex in use.

It is the object of this invention to provide a portable roller swaging tool to minimize the shortcomings of the prior known roller swaging tools.

SUMMARY

By this invention a roller swaging tool is provided which overcomes the disadvantages of known roller swaging tools.

According to the invention, a roller swaging tool comprises a swaging unit with a mandrel, rollers and a cage for permitting roller movement relatively radially outwardly from the cage as the mandrel is urged axially forward in the cage. Separable components hold a sleeve in operable relationship. As such, a tube can be swaged into engagement with the sleeve. A retainer engages the separable components and locates the components and fitting operably with the swaging unit. In an operable swaging relationship the sleeve is positively locked with the swaging unit to form an integral unit.

The components are separated longitudinally into at least two components and have a threaded outer surface for engaging a threaded inner surface of the fitting retainer.

The rollers are secured in the cage by a roller retainer movable about the cage, and the inner surface of the roller retainer engages the rollers. Spring means acts to urge the roller retainer into position over the rollers. A groove in the roller retainer secures the free-end of the spring, and the spring means engages in the groove thereby to secure the roller retainer to the spring means. An internal housing in a guard for the cage positively locates the other end of the spring means with the swaging.

The mandrel includes a tapered surface which engages with rollers which also have a tapered surface. The angle of the tapered surface of the mandrel is significantly larger than the angle of the rollers.

The invention is further described with reference to the accompanying drawings.

DRAWINGS

Figure 1:
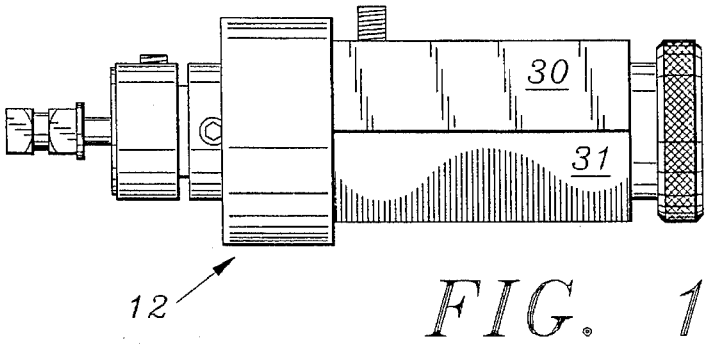
FIG. 1 illustrates a side view of a roller swaging tool as an integral unit with the fitting retainer and separable components located in the fitting retainer.
Figure 2:
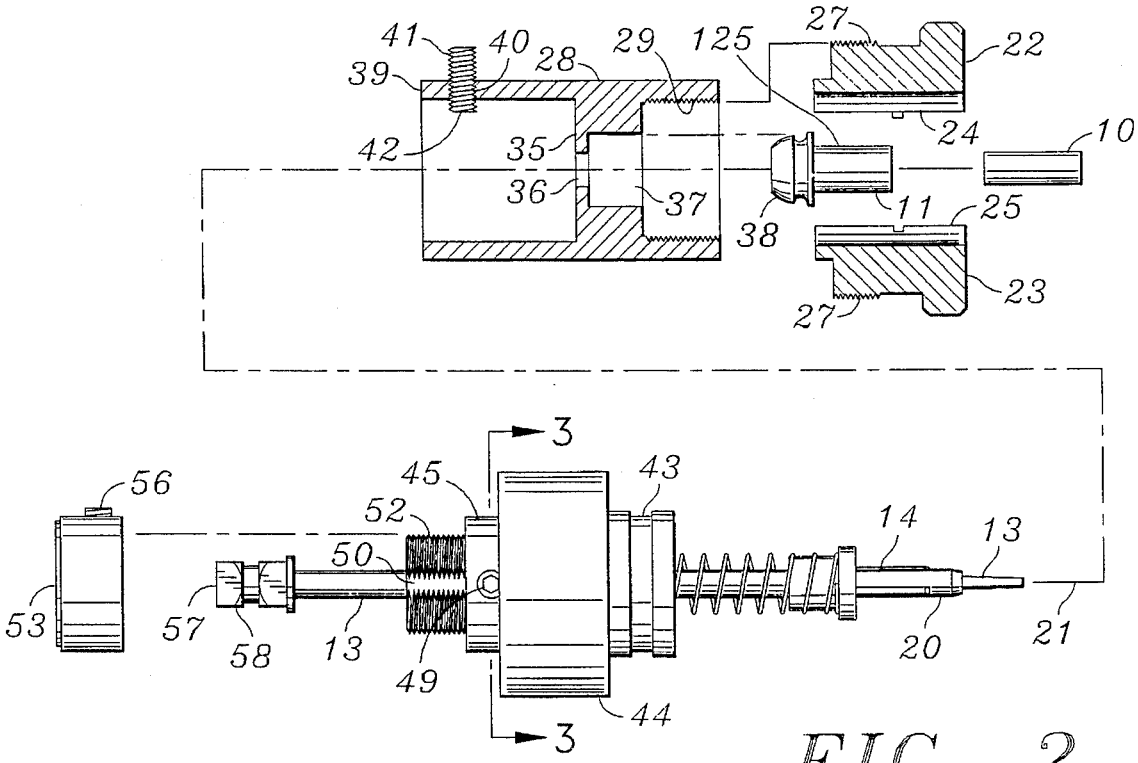
FIG. 2 is an exploded view of a roller swaging tool with a cross sectional view of the fitting retainer and a cross sectional view of the components split apart with a sleeve between the component parts.
Figure 3:
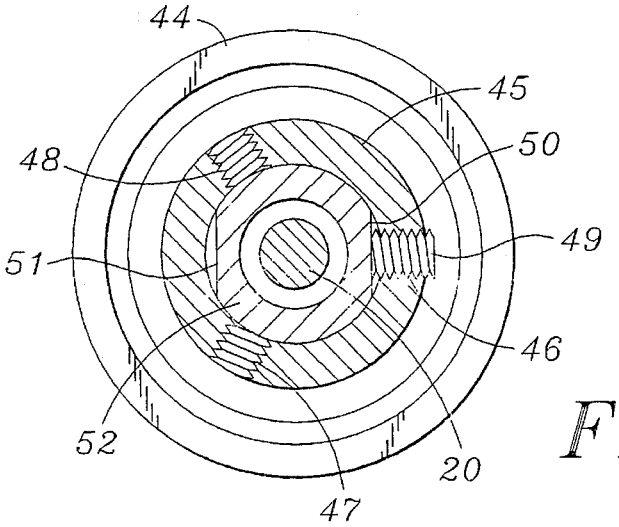
FIG. 3 is an in view along line 3—3 of FIG. 2 showing the guard and a locknut.
Figure 4A:
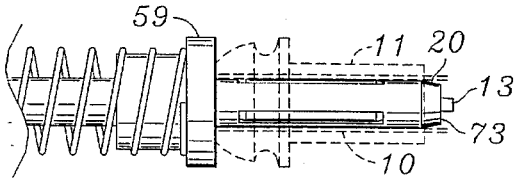

FIG. 4*a* is a partial view of a spring and sleeve means in engagement with a cage having rollers. A sleeve and tube are shown in phantom with a mandrel in a retracted position in the cage.

Figure 4B:
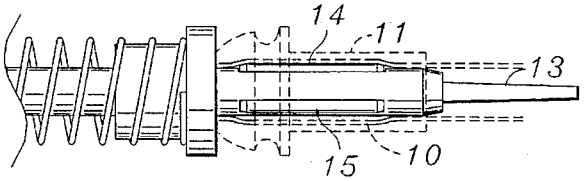

FIG. 4*b* is a similar view to FIG. 4*a* with the mandrel further extended axially through the cage and the rollers extending radially from the cage.

Figure 5A:
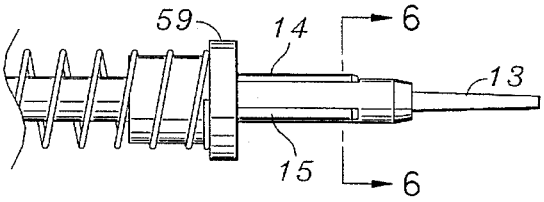

FIG. 5*a* is a similar view to FIG. 4*b* without a sleeve. The mandrel is in an extended position.

Figure 5B:
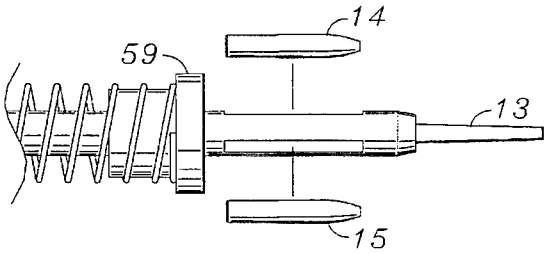

FIG. 5*b* is a similar view to that illustrated in FIG. 5*a*, with the spring and sleeve retracted further. The rollers are ejected from apertures of the cage.

Figure 6:
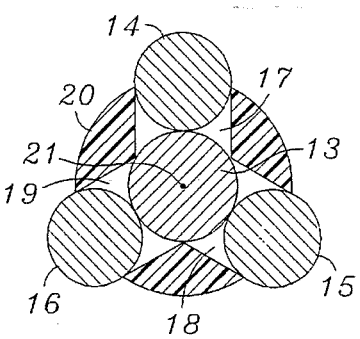

FIG. 6 is a view along lines 6—6 of FIG. 5*a* showing the rollers in engagement with the mandrel inside the cage.

Figure 7:
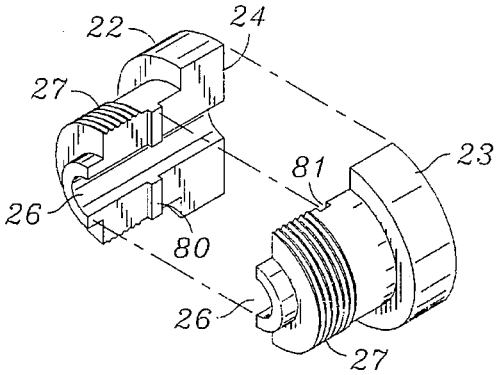

FIG. 7 is an exploded view of two components for locating the sleeve.

Figure 8:
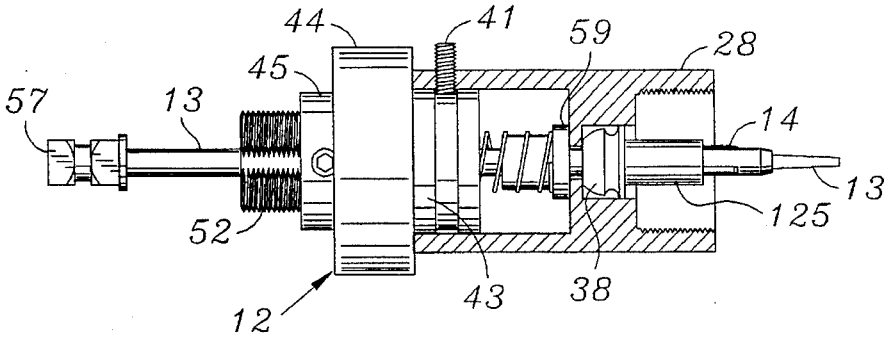

FIG. 8 is a partially sectioned side view of the roller swaging tool. The fitting retainer is shown in sectional view with a socket head set screw engaging a groove in a roller swaging tool.

Figure 9:
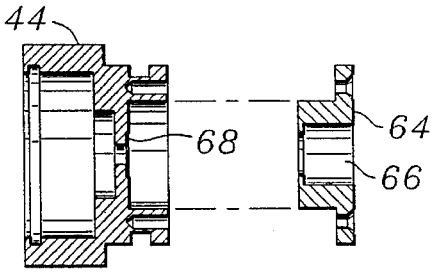

FIG. 9 is a sectional side view of an internal housing for locating within the leading end of the roller swaging tool namely a guard, for securing the adjacent end of the spring means.

Figure 10:
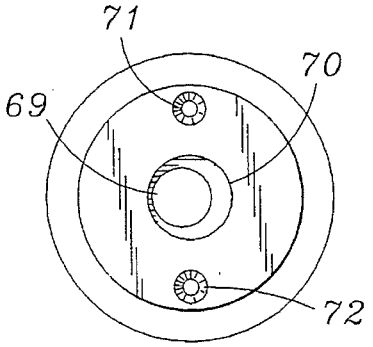

FIG. 10 is a front view of FIG. 9 showing an eccentric aperture for engaging the spring.

Figure 11:
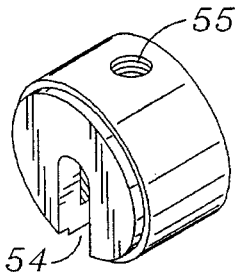

FIG. 11 is an isometric view of a retaining cap for mandrel adjustment. It is screwed to the threaded end of the cage.

Figure 12:
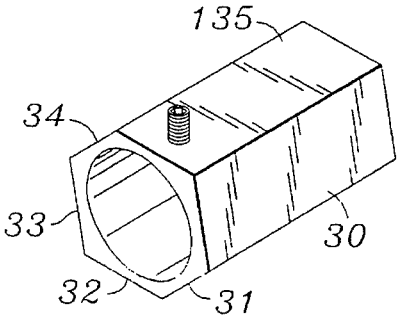

FIG. 12 is an isometric view of a fitting retainer.

Figure 13:
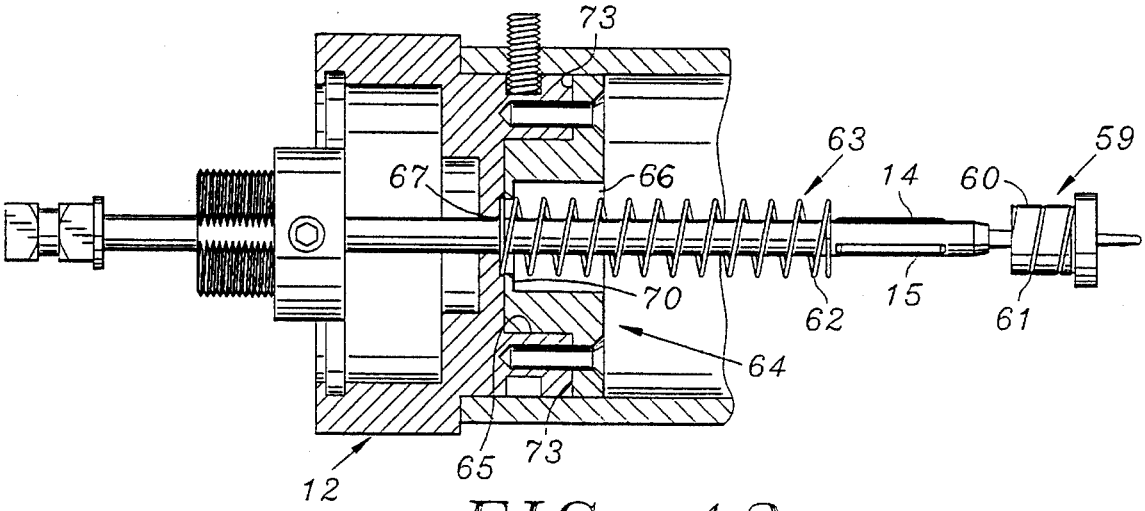

FIG. 13 is a side view of a roller swaging tool, showing some components in section. The sectional components include the internal housing for securing the spring, and also show the fitting retainer secured by means of a socket head set screw into a groove around the guard of the swaging unit.

Figure 14:
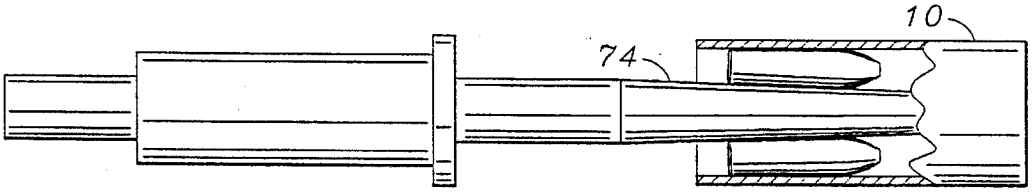

FIG. 14 is a side view of a mandrel engaging rollers with a tube in section about the rollers.

Figure 15:
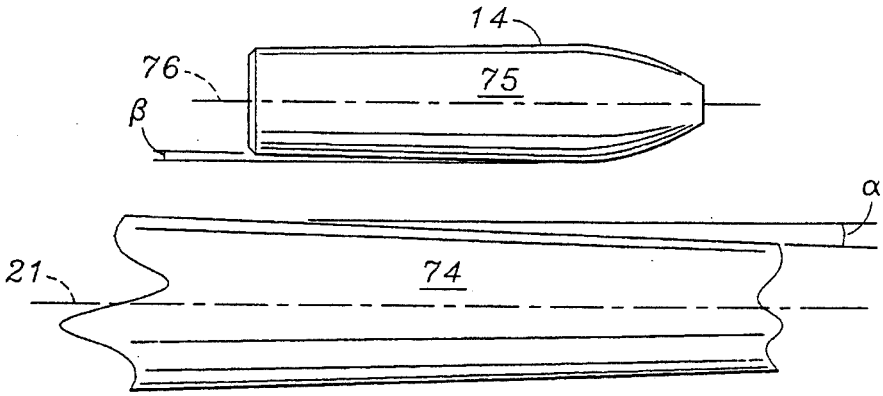

FIG. 15 is an enlarged view of the portion of mandrel engaging the rollers and illustrating the angles of the mandrel tapered surface and the roller tapered surface.

DESCRIPTION

Apparatus for swaging a tube 10 to a sleeve 11 includes a swaging unit 12. The unit includes a mandrel 13, and rollers 14, 15, and 16 radially directed in apertures 17, 18 and 19 in a cage 20. As the mandrel 13 moves axially forwardly, the rollers 14, 15, and 16 are urged radially outwardly relative to axis 21 passing centrally through the mandrel 13.

Separable components 22 and 23 are split longitudinally along their faces 24 and 25 respectively. When so split a sleeve 11 which has a cylindrical body 125 can be fitted inside a bore 26 directed centrally through the components 22 and 23. With the surfaces 24 and 25 flush a single unit is obtained for holding the sleeve 11 in operable relationship whereby the tube 10 can be swaged into engagement with the sleeve 11.

The outer circumferential surface 27 of the fitting 22 and 23 are threaded to engage inside a fitting retainer 28. The inside surface 29 of the fitting retainer 28 is threaded to receive the threads 27 of the components 22 and 23. In this manner, components 22 and 23 are held firmly together with the sleeve 11 positively inside the components 22 and 23.

The retainer 28 includes multiple outer surfaces 30, 31, 32, 33, 34, and 135 which forms a hexagonal retainer construction on the outer surface. Internally, a bridge portion 35 is provided with a central bore 36 for receiving the cage 20 and mandrel 13. A counter bore 37 would locate the head 38 of the sleeve 11.

Adjacent to the end 39 of the fitting retainer 28, there is an aperture 40 receiving a socket head set screw 41. The free-end 42 of the socket head set screw 41 engages in a circular groove 43 forward of the guard 44 of the swaging unit 12. By advancing the socket head set screw 41 downwardly the fitting retainer 28 forms a positive engagement with the guard 44 of the swaging unit 12. The components 22 and 23 located in the fitting retainer 28 form part of the integral relationship. As such, the swaging unit 12 and fitting retainer 28 and components 22 and 23 form an integral unit.

On the rearward side of guard 44 surrounding the cage 20, there is provided a locknut 45 with three space apertures 46, 47 and 48 respectively. Through the apertures and the screws one or more socket head set screws 49 can be inserted to engage a flat 50 on one or more flats 50 or 51 on the outside peripheral surface of the cage 20.

A fine threaded surface 52 is provided on the outside of the cage 20 so that the locknut can be very precisely indexed relative to the cage 20. In the manner, the location of the cage relative to the guard can be adjusted finely so that the apertures 17, 18 and 19 are positioned the correct distance from the face of the guard 44. In this fashion, the actual length of swaging of the tubing 10 onto the sleeve 11 can be precisely controlled.

Additionally to the locknut 45 there is provided a retaining cap 53 which has a threaded inner surface which is also threadable unto the surface 52 to facilitate adjustment of the mandrel with respect to the cage 20. The retaining cap includes a slotted formation 54 to facilitate removal from the mandrel 13. A circular aperture 55 opposite the slotted aperture 54 is provided and a socket head set screw 56 through the aperture 55 would engage in one or more of the flats 50 or 51 of the cage surface as required.

The mandrel 13 at the free-end 57 includes a section shaped as a square 58 for engaging with a tool to facilitate rotation and for movement of the mandrel within the cage 20 and to affect swaging. Such tool will also facilitate reverse rotation and retraction of the mandrel 13 from the cage 20 to release the mandrel and rollers 14, 15, and 16 from engagement with the inside surface of the tube 10 after swaging.

On the forward side of the guard 44 adjacent to the roller retainer engaging part of the cage 20 there is a provided roller retainer means 59 with a bore so that the roller retainer 59 can ride over the outer surface of the cage 20. The internal bore of the roller retainer 59 would engage with the outer surfaces of rollers 14, 15, and 16, when the roller retainer 59 is located over the rollers as illustrated in FIG. 5*a*. This retains the rollers 14, 15, and 16 within the apertures 17, 18, and 19 respectively of the cage 20. The outside surface 60 of the roller retainer 59 includes a helical groove 61 for engaging with a coil end 62 of a spring 63. The spring 63 is urged forwardly to keep the roller retainer 59 in a normal position over the rollers 14, 15, and 16.

The end of the spring 63 opposite to the end having coil 62 engages with the swaging unit 12 through an internal housing 64 which fits in a bore 65 of the swaging unit 12. The internal housing 64 includes an internal bore section 66 for receiving the spring 63. The remote coil 67 of the spring 63 fits in a slot 68 which is at the forward end of the guard 64. The slot 68 is concentric with the aperture 69 through the guard 44. An eccentric aperture 70 is provided to the end of the internal bore 66 and this traps the coil 67 of the spring 63. In this manner spring 63 is firmly engaged with the swaging unit at the end 67 in addition to the end 62. The internal housing 64 is connected with screw means 71 and 72 to the end 73 of the guard 44.

In operation, the roller retainer 59 is forced rearwardly toward the guard 44. The tube 10 within the sleeve 11 acts to ensure that the rollers 14, 15, and 16 are retained in the apertures 17, 18, and 19 respectively, while the roller retainer 59 is pushed backwardly.

As the mandrel 13 is pushed forwardly as illustrated in FIG. 4*b*, rollers 14, 15, and 16 are urged outwardly. The tubing 10 still retains the rollers in position and prevents them from falling out of the apertures 17, 18, and 19. Without the sleeve 11 and tube 10 in position, the roller retainer 59 holds the rollers 14, 15, and 16 in position as indicated in FIG. 5*a*. With the roller retainer 59 removed as illustrated in FIG. 5*b* and without the tube 10 and sleeve 11 in the place, the rollers 14, 15, and 16 are removable through apertures 17, 18, and 19 of the cage 20.

The mandrel 13 has a tapered outer surface 74 which tapers towards the leading end of the mandrel 13. The surface 74 defines an angle relative to the axis 21. This angle is a first angle $\alpha$ which is in a range between about 1 degree and about 2.8 degrees. Preferably it is about 2 degrees.

The rollers 14, 15, 16 have an outside surface 75 which have a tapered relationship relative to the axis 76 running axially through each roller 75. The angle $\beta$ of the tapered surface 75 of the rollers 14, 15, 16 is in a range between about 0.4 degrees and about 1.3 degrees, and preferably about 0.7 degrees.

The angle $\alpha$ is significantly larger than the angle $\beta$. This difference provides for longevity of the mandrel and roller interface and the relationship is an important feature of increased longevity of the mandrel 13 and the rollers 14, 15, and 16. Normally it would be expected that with the angles $\alpha$ and $\beta$ about equal the appropriate interengaging affect would have been achieved.

When using the swaging unit of the present invention, the sleeve 11 is located in position within the separable components 22 and 23. These components are brought together and threaded within the fitting retainer 28 which has been secured to the swaging unit 12. In an alternative form of use the fitting retainer 28 is located firstly in the swaging unit and the components 22 and 23 are introduced thereafter. To facilitate locating components 22 and 23 together, there is an interengaging transverse tooth 80 and mating transverse slot 81.

As the mandrel is urged forwardly under the action of a mechanized tool or torque wrench, the swaging effect of the tube 10 on the sleeve 11 is affected. The locknut can be held in a vice or in a hand while the swaging is affected by a torque wrench. The torque wrench which engages retainer 58 would indicate when sufficient torque has been applied to secure the sleeve 11 with the tube 10.

General

The swaging apparatus of the invention provides a useful portable device which is easily operable by unskilled operators.

Many variations of the embodiment are now possible without departing from the invention. For instance, of hexagonal outer face would be lock fitting other cross sections are possible, for instance square or octagonal or even round. Other characteristics for securing the spring over the cage are possible.

Many other forms of the inventions exist, each differing from others in matters of detail only. The invention is to be determined solely by the following claims.

I claim:

1. Apparatus for swaging a tube to a fitting comprising:

(a) a swaging unit including a mandrel, rollers, a cage having apertures for permitting roller movement relatively radially outwardly from the cage as the mandrel is urged axially forwardly into the cage;

(b) separable components for holding a sleeve in operable relationship whereby a tube can be swaged into engagement with the sleeve; and (c) a fitting retainer for engaging the separable components and for locating the components and sleeve operably with the swaging unit such that in an operable swaging relationship the fitting retainer is positively locked with the swaging unit to form an integral unit.

2. Apparatus as claimed in claim 1 wherein the separable components are split longitudinally into at least two components, the separable components including a threaded outer surface for engaging a threaded inner surface of the fitting retainer.

3. Apparatus as claimed in claim 1 wherein the rollers are secured in the cage by a roller retainer movable about the cage, the inner surface of the roller retainer engaging the rollers, and spring means acting to urge the roller retainer into a position over the rollers.

4. Apparatus as claimed in claim 3 wherein the roller retainer includes a groove for securing a free end of the spring means such that the spring means engages in the groove thereby to secure the roller retainer to the spring means.

5. Apparatus as claimed in claim 3 including an internal housing for location in a guard for the cage, the internal housing having an aperture for receiving an end of the spring remote from the spring end with the roller retainer, the aperture being a relatively eccentric offset for engaging a coil of the spring thereby to affix the spring with the internal housing and the guard.

6. Apparatus as claimed in claim 1 wherein the fitting retainer engages with the swaging unit by means of a stud engaging a groove in the guard surrounding the cage.

7. Apparatus as claimed in claim 1 wherein the mandrel includes a tapered mandrel surface which is tapered towards a forward position, the tapered mandrel surface having a first angle defined relative to an axis through the mandrel, and wherein the rollers have a tapered roller surface which is tapered towards a leading position, the tapered roller surface having a second angle defined relative to an axis through the rollers, and wherein the first angle is significantly larger than the second angle.

8. Apparatus as claimed in claim 1 including a locknut for threaded engagement with the cage, the locknut being for adjusting the relative location of the cage in the guard whereby the position of the guard relative to axial location of the cage apertures is adjustable, the locknut being engagable in a selected location with a threaded portion of the guard thereby to establish the relationship of the guard relative to the cage apertures.

9. Apparatus as claimed in claim 8 including a removable retaining cap for engagement with a free end of the cage thereby to facilitate adjustment of the mandrel and the cage.

10. Apparatus for swaging a tube with a sleeve comprising:

(a) a swaging unit including a mandrel, rollers, a cage having apertures for permitting roller movement relatively radially outwardly from the cage as the mandrel is urged axially forwardly into the cage, the rollers being secured in the cage by a roller retainer movable about the cage, the inner surface of the roller retainer engaging the rollers, and spring means acting to urge the roller retainer into a position over the rollers;

(b) separable components for holding a sleeve in operable relationship whereby a tube can be swaged into engagement with the sleeve; and (c) a fitting retainer for engaging the separable components and for locating the components and sleeve operably with the swaging unit such that in an operable swaging relationship the fitting retainer is positively locked with the swaging unit, wherein the separable components being split longitudinally into at least two components, the separable components including a threaded outer surface for engaging a threaded inner surface of the fitting retainer.

11. Apparatus as claimed in claim 10 wherein the roller retainer includes a groove for securing a free end of the spring means such that the spring means engages in the groove thereby to secure the roller retainer to the spring means, and including an internal housing for location in a guard for the cage, the internal housing having an aperture for receiving an end of the spring remote from the spring end with the roller retainer, the aperture being relatively eccentric offset for engaging a coil of the spring thereby to affix the spring with the internal housing and the guard.

12. Apparatus as claimed in claim 11 wherein the fitting retainer engages with the swaging unit by means of a stud engaging a groove in the guard surrounding the cage.

13. Apparatus for swaging a tube with a sleeve using a swaging unit including a mandrel, rollers, a cage having apertures for permitting roller movement relatively radially outwardly from the cage as the mandrel is urged axially forwardly into the cage, wherein the mandrel includes a tapered mandrel surface which is tapered towards a forward position, the tapered mandrel surface having a first angle defined relative to an axis through the mandrel, and wherein the rollers have a tapered roller surface which is tapered towards a leading position, the tapered roller surface having a second angle defined relative to an axis through the rollers, and wherein the first angle being significantly larger than the second angle.

14. Apparatus as claimed in claim 13 wherein the rollers are secured in the cage by a roller retainer movable about the cage, the inner surface of the roller retainer engaging the rollers, and spring means acting to urge the roller retainer into a position over the rollers.

15. Apparatus as claimed in claim 14 wherein the roller retainer includes a groove for securing a free end of the spring means such that the spring means engages in the groove thereby to secure the roller retainer to the spring means.

16. Apparatus as claimed in claim 14 including an internal housing for location in a guard for the cage, the internal housing having an aperture for receiving an end of the spring remote from the spring end with the roller retainer, the aperture being a relatively eccentric offset for engaging a coil of the spring thereby to affix the spring with the internal housing and the guard.

17. Apparatus as claimed in claim 13 including a locknut for threaded engagement with the cage, the locknut being for adjusting the relative location of the cage in the guard whereby the location of the cage apertures relative to the face of the guard is adjustable, the locknut being engagable in a selected location with a threaded portion of the cage thereby to establish the relationship of the apertures relative to the cage.

18. Apparatus as claimed in claim 10 including tooth means and slot means for securing together the separable components.

* * * * *